United States Patent [19]

Zanatta et al.

[11] Patent Number: 4,731,940

[45] Date of Patent: Mar. 22, 1988

[54] ADJUSTING DEVICE FOR THE ARCH OF THE FOOT OF THE INSOLE OF SHOES, BOOTS AND THE LIKE

[75] Inventors: Giancarlo Zanatta, Nervesa della Battaglia; Antonello Marega, Montebelluna, both of Italy

[73] Assignee: Calzaturificio Tecnica Spa, Treviso, Italy

[21] Appl. No.: 926,075

[22] Filed: Nov. 3, 1986

[30] Foreign Application Priority Data

Nov. 5, 1985 [IT] Italy ..... 23745 B/85[U]

[51] Int. Cl.[4] ..... A43B 7/22; A43B 13/38; A43B 5/04

[52] U.S. Cl. ..... 36/91; 36/44; 36/119; 128/596

[58] Field of Search ..... 36/91, 43, 44, 117, 36/119; 128/596–606

[56] References Cited

U.S. PATENT DOCUMENTS

| | | | |
|---|---|---|---|
| 1,527,444 | 2/1925 | Sable | 128/601 |
| 1,694,582 | 12/1928 | Christianson | 128/596 |
| 1,904,789 | 4/1933 | Howell | 128/597 |
| 2,075,942 | 4/1937 | Howell | 128/597 X |
| 2,113,898 | 4/1938 | Nethus | 128/597 |
| 2,390,416 | 12/1945 | Bettmann | 128/597 X |
| 3,828,448 | 8/1974 | Leonildo | 36/119 |
| 4,314,411 | 2/1982 | Hanson | 36/91 X |

FOREIGN PATENT DOCUMENTS

| | | | |
|---|---|---|---|
| 137043 | 5/1920 | United Kingdom | 128/597 |

*Primary Examiner*—James Kee Chi

*Attorney, Agent, or Firm*—Murray and Whisenhunt

[57] ABSTRACT

Adjusting device of the arch of the foot for the insole of shoes, boots and the like, formed by a deformable half-dome, shaped likewise the arch of the foot of a human foot, which is anchored to at least three slidable constraint points and is provided with height adjusting means, such as a wedge shaped element slidable inwardly and outwardly with respect to said half-dome.

6 Claims, 4 Drawing Figures

ADJUSTING DEVICE FOR THE ARCH OF THE FOOT OF THE INSOLE OF SHOES, BOOTS AND THE LIKE

The present invention relates to an adjusting device for the arch of the foot of the insole of shoes, shoes suitable for supporting the foot in static conditions, such as in the practice of some sports or gynnastic exercises, like hockey, skating or weight-lifting and especially for the insoles of ski-boots.

It is known that the human foot is provided in its sole portion wih an arch shaped recess called arch of the foot. Such an arch of the foot does vary from one to another human being, it having more or less height and more or less extension.

Beforehand when a shoes was manufactured comprising an essentially rigid insole, it was necessary to provide in said insole a fixed curvature as much as possible suitable for the individual curvatures of human feet, shapes and sizes were selected, resulting from statistical studies, which would adapt themselves, as a good compromise to the single curvatures of the arches of the feet. Said compromise might be furthermore relvantly improved by using cushioning materials over said rigid foot arches.

Obviously, possible excessive deviations of the individual foot arches with respect to the fixed curvature of the insole were compensated for the restraining deformations of the foot which, if falling within tolerable limits, did not cause too heavy physiological problems.

However, owing to the danger which might result from an extended deformation of foot soles, it would be desirable to find out means permitting the essentially rigid insole of a shoes to fit the effective curvature of the foot arch of a foot wearing the same.

To this end it is possible to use a flexible sheet-like element, having essentially invariable extension, which is slidably fixed in three or more points of the insole and provided with means for varying the height of said element, whereby by varying the height its whole curvature is varied.

More particularly said element, essentially shaped as a half-dome or as half-dome having substantially parabolic base, or the like, restrained so as to be slidable in two directions tangent to the insole and perpendicular to each other, one of which does follows a chord of said parabolic base and the other follows the axis of the same passing through its apex, the height of said half-dome being adjusted by means of variable height means which can be inserted between said-half dome and the underlying insole.

Said variable height means are particularly formed by a wedge which can be inserted in adjustable manner under said half-dome.

In order to better understand the present invention reference is made to the following detailed description of an embodiment thereof, according to the enclosed drawings, wherein:

FIG. 1 does schematically illustrate a rigid ski-boot, comprising a device for the adjusting of the foot arch according to the present invention, FIG. 2 is a plan view from above of an insole of a ski-boot comprising the said device according to the invention;

Figure 1:
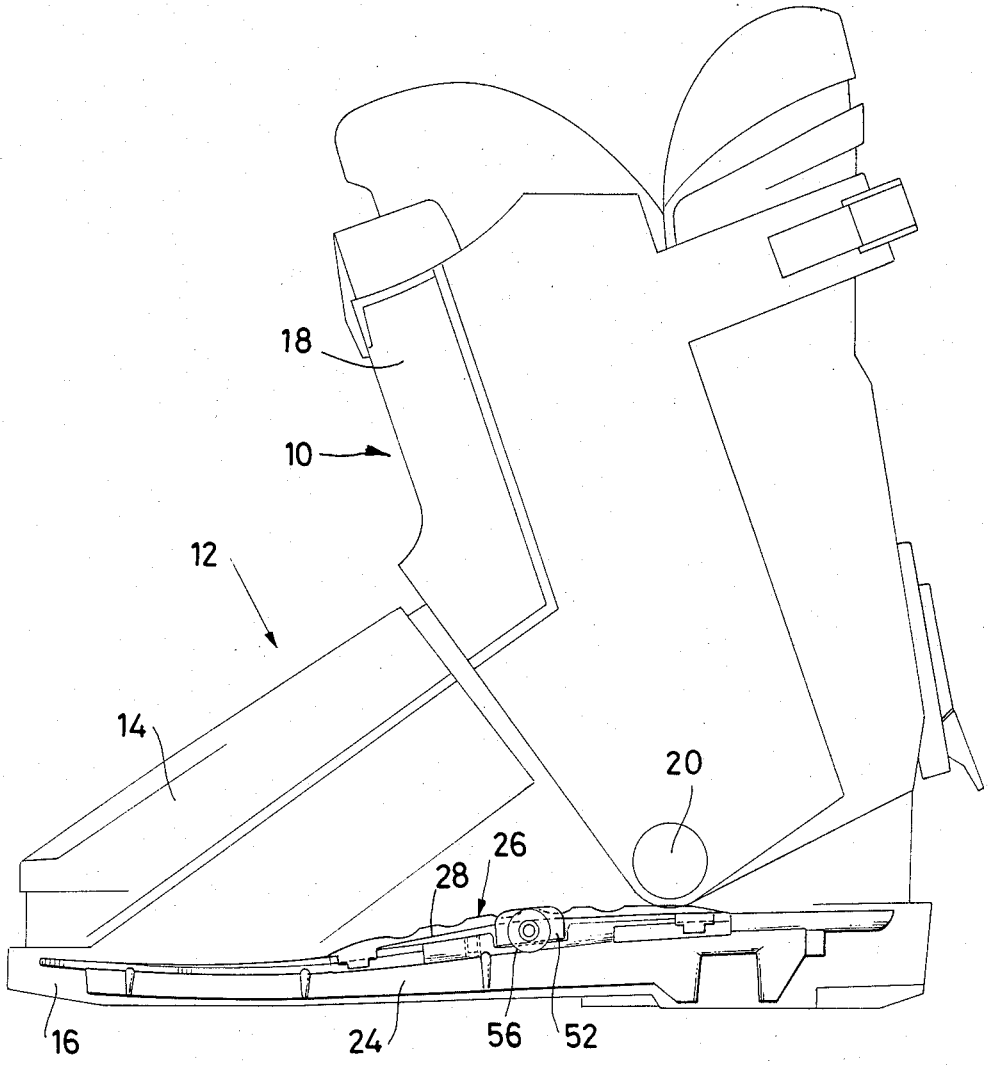
Figure 2:
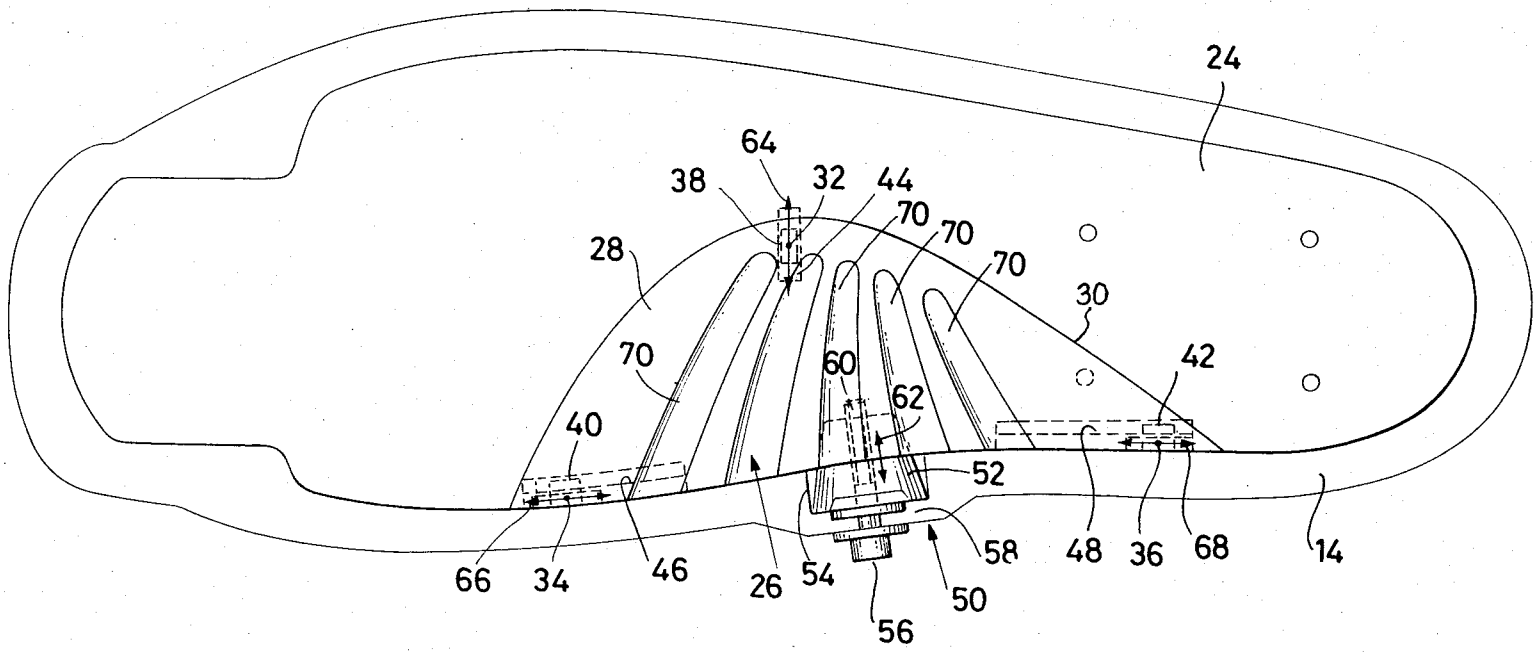
Figure 3:
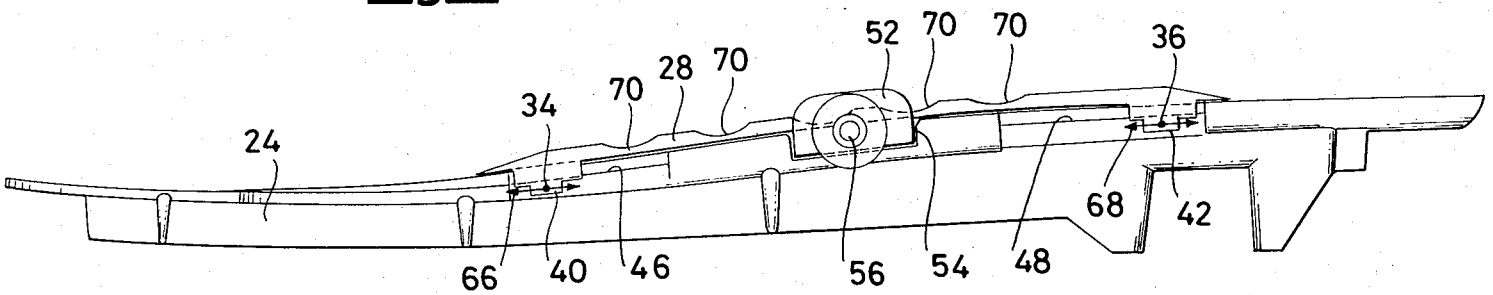
FIG. 3 is a side elevation view of the same insole of FIG. 2.
Figure 4:
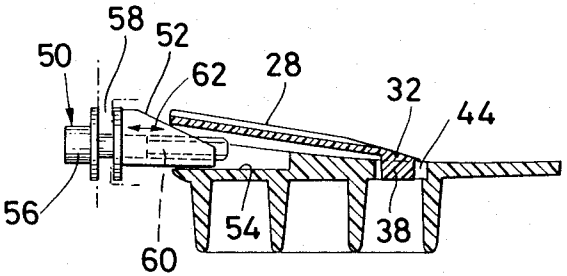
FIG. 4 is a cross-section view, in enlarged scale showing an embodiment of the means for varying the height of the device according to the invention.

Considering now the drawings and particularly FIG. 1 it can be seen that a rigid ski-boot 10 comprises a rigid outer shell or casing 12 including an upper 14 and a sole 16, integrally formed and connected to a bootleg, also rigid, 18, which can be connected to the upper through knuckles 20. The integral sole 16 is provided with recessed portions for housing an insole 24, complementary to said recessed portions, serving to support an inner liner (not shown) by which the foot is received and contained within the ski-boot.

This insole is that which must be provided with a curve area 26 adapted to support and to fit to the foot arch of a foot wearing the boot and this curved area 26 does form the device of the present invention, as shown in FIGS. 1 to 4.

Said adjusting device comprises a sheet element 28, which is flexible but so poorly yieldable to maintain a curved shape even when abutted onto limited areas and to maintain furthermore an essentially unchanged extension (namely the area of said element is neither increased nor reduced under mechanical stresses). Said flexible element has a general shape like a half-dome having essentially parabolic base, or the like, which is abutted onto the insole 24 along the peripheral outline 30 of parabolic shape, or at least on three points 32, 34 and 36, the first of which 32 is close to the apex of the parabolic outline, whereas those 34 and 36 are near to the border line between the sheat element 28 and the wall of the upper 14. From these three points 32, 34 and 36 three guide appendixes or sliding blocks, 38, 40 and 42 respectively, protrude, which enter and are slidable into three elongated windows, 44, 46 and 48 respectively, formed through the insole 24.

In order to adjust the height of the flexible sheet element 28, an abutting member 50 is used, having variable height, such as for instance a wedge 52, slidably housed within a lowered guide seat 54 formed in the insole 24. In order to cause said wedge 52 to slidably run toward inside and outside with respect to the insole 24, said wedge is provided with a screw 56 engaging in abutting manner a wall 58 fixed to the upper 14, said screw having threaded stem 60 screwed into a corresponding threaded hole formed through the wedge 52.

Obviously the sheet element 28 is completed by other necessary provisions, such as grooves 70 adapted to promote the adhesion thereto of cushioning pads and the like intervening or being part of the liner inserted into the boot.

The operation of the present invention is as follows: once the foot is inserted withing the boot and the strings of the liner are tightened, the height of the foot arch is adjusted by rotating, obviously from the outside of the boot, in either direction the side screw 56 until a comfort sensation is felt indicating that the sheet element 28 is perfectly fitted to the height of the foot arch of the foot inserted within the boot. The whole manoeuver of adjusting of the sheet element 28 to the height of the foot arch of the person wearing the boot takes place without it being necessary to remove the foot from the boot.

The height of the foot arch is achieved by the wedge 52 which, penetrating inwardly according to the arrow 62, causes the sheet element 28 to be raised, the latter however remaining with the outline 30 thereof adherent to the insole 24, thanks to the body weight of the person, whereas the guide shoes 38, 40 and 42, are run inwardly according to the arrows 64, 66 and 68 respectively. On the contrary, when the wedge 52 is moved outwardly the body weight of the person causes the sheet element 28 to be lowered and the guide shoes 38, 40 and 42 to be displaced outwardly.

Of course, the screw device 56 permitting the wedge 52 to be inserted and withdrawn can be subsituted for by equivalent devices, such as cam, bell-crank lever devices and the like capable or originating an equal displacement of the wedge 52, as well as said wedge 52, which in the drawings is shown in straight shape, can be substitued for by a cam shaped as a circle sector, with an inclined face, which can be introduced by rotation under the sheet element 28.

We claim:

1. An adjustable foot arch for the insole of a shoe, said foot arch being of variable height and shape, comprising:

a flexible sheet member having an essentially unvariable extension, said flexible sheet member being shaped as a half-dome with an essentially parabolic base having a predetermined curvature, said parabolic base having an apex and an axis passing through said apex, said flexible sheet member being slideable relative to said insole;

restraining means for slidably connecting said flexible sheet member to said insole at at least three points on said insole, said restraining means limiting sliding movement between said flexible sheet member and said insole to sliding movement in a first direction and sliding movement in a second direction, said first and second directions being substantially perpendicular to each other, said first direction extending along a chord of said parabolic base and said second direction extending along said axis passing through said apex;

height varying means, adjustably insertable between said half-dome and said insole, for varying the height of at least one point on said flexible sheet member relative to said insole so as to change said curvature of said flexible sheet member;

adjustment means, operably connected to said height varying means, for causing adjustable insertion of said height varying means between said half-dome and said insole, said adjustment means being accessible externally of said shoe and being operable by the wearer of said shoe, when the shoe is being worn.

2. The adjustable foot arch according to claim 1, wherein said height varying means comprises a wedge which can be adjustably inserted under said half-dome.

3. The adjustable foot arch according to claim 2, wherein said wedge is inserted under said half-dome by the action of a screw provided with a threaded stem which is threaded through said wedge.

4. The adjustable foot arch according to claim 2, wherein said wedge is inserted under said half-dome by the action of a cam mechanism.

5. The adjustable foot arch according to claim 2, wherein said wedge is inserted under said half-dome by the action of a bell-crank lever.

6. The adjustable foot arch according to claim 1, wherein said height varying means comprises a circle sector cam having a first face parallel to said insole and a second face inclined to said insole so as to obtain a variable height depending on rotation of said cam.

* * * * *